US005330325A

United States Patent [19]

Kato et al.

[11] Patent Number: 5,330,325

[45] Date of Patent: Jul. 19, 1994

[54] AGITATING VANE

[75] Inventors: Kohichi Kato, Warabi; Shigeru Nishioka, Tokyo, both of Japan

[73] Assignee: Satake Chemikal Equipment Mfg., Ltd., Moriguchi, Japan

[21] Appl. No.: 100,293

[22] Filed: Aug. 2, 1993

Related U.S. Application Data

[62] Division of Ser. No. 905,315, Jun. 29, 1992, Pat. No. 5,277,550.

[30] Foreign Application Priority Data

Oct. 17, 1991 [JP] Japan ..... 3-298551
Oct. 17, 1991 [JP] Japan ..... 3-298552

[51] Int. Cl.[5] ..... B01F 7/16

[52] U.S. Cl. ..... 416/227.00 R; 416/227 A; 416/198 R

[58] Field of Search ..... 416/227 R, 227 A, 231 A, 416/198 R

[56] References Cited

U.S. PATENT DOCUMENTS

| | | | |
|---|---|---|---|
| 1,345,055 | 6/1920 | Willour | 416/227 A |
| 1,813,877 | 7/1931 | Gunn | 416/227 A |
| 1,828,819 | 10/1931 | Rosenberg et al. | 416/227 A |
| 2,103,243 | 12/1937 | Bradford, Jr. | 416/227 A |
| 2,469,919 | 5/1949 | Fischer | 416/227 A |
| 3,704,009 | 11/1972 | Kalbskopf | 416/227 A |

*Primary Examiner*—Edward K. Look
*Assistant Examiner*—Michael S. Lee
*Attorney, Agent, or Firm*—Oblon, Spivak, McClelland, Maier & Neustadt

[57] ABSTRACT

A plurality of flat plates are laterally disposed at an outer circumference of a hub and auxiliary vanes are disposed in parallel to at least side edges of each of said flat plates while being spaced apart from the side edges. Accordingly, an occurrence of eddy flows can be restricted, a peeling-off eddy flow can be reduced, agitating and mixing of gas-liquid can be made efficient without producing any damage to microorganisms or the lie and an agitating efficiency can be improved with a simple structure.

5 Claims, 5 Drawing Sheets

AGITATING VANE

This is a division of application Ser. No. 07/905,315, filed on Jun. 29, 1992, Pat. No. 5,277,550.

BACKGROUND OF THE INVENTION

1. Field of the Invention

This invention relates to agitating vanes of an agitating device for agitating and mixing liquid or gas contained in a container in food processing industries and chemical industries or the like.

2. Description of the Related Art

Conventional vanes are provided as flat plates laterally disposed in a predetermined angular spacing at an outer circumference of a rotary shaft or single-plated belt-like vanes radially projected at a hub of the rotary shaft and slanted in a rotational direction of the rotary shaft.

This known agitating vane had problems in that eddy currents or flows are generated at the rear portions of the circumferences of the flat plates during rotation of the rotary shaft and a shearing force may act against the liquid to damage microorganisms in the liquid due to breakage of air bubbles caused by the eddy flows. In addition, the agitating vane had problems in that eddy flows are generated at the upper surfaces of the rear ends of the single-plated vanes in a rotational direction during rotation of the agitating vanes as a result of which the liquid is peeled off along with the eddy flows, a circulating speed of the liquid is decreased due to such peeling-off and the agitating efficiency is decreased.

SUMMARY OF THE INVENTION.

It is an object of the present invention to reduce an occurrence of eddy flows, reduce peeled-off eddy flows and provide an efficient agitating and mixing of gas-liquid without damaging microorganisms or the like.

It is another object of the present invention to increase agitating efficiency with a simple structure.

In order to achieve these objects, the present invention provides a plurality of flat plates which are laterally disposed at an outer circumference of the hub and several auxiliary vanes are mounted at side edges of each of the flat plates, in parallel with the side edges and in spaced-apart relation therefrom.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
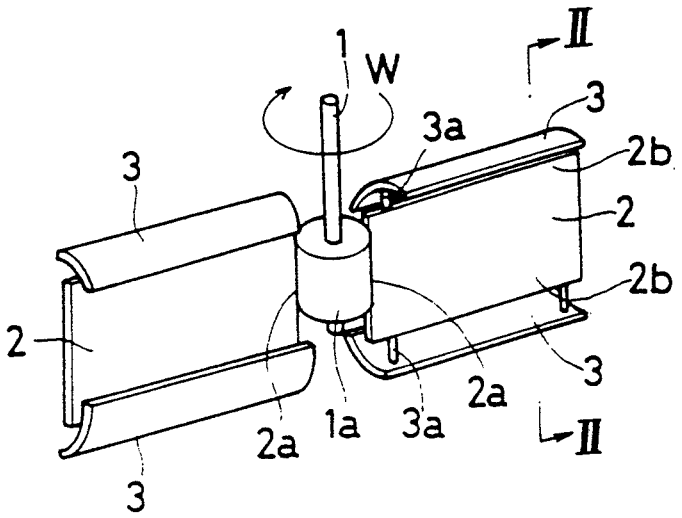
FIG. 1 is a perspective view showing the first preferred embodiment of the present invention.
Figure 2:
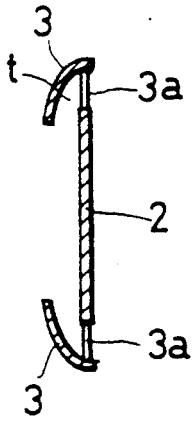
FIG. 2 is a sectional view taken along a line II—II of FIG. 1.
Figure 3:
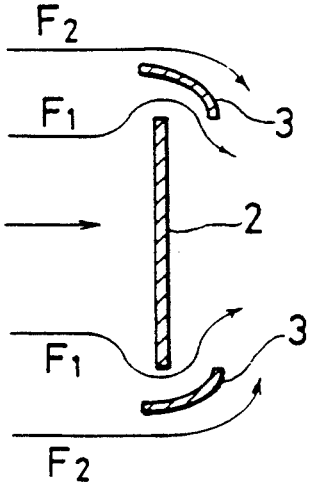
FIG. 3 is an illustrative view showing a state of flow.

Referring now to FIGS. 1 to 3, the first preferred embodiment of the present invention will be described.

Reference numeral 1 denotes a rotary shaft. To the rotary shaft is fixed a hub 1*a* and the rotary shaft 1 is rotated in the direction of an arrow W. Reference numerals 2 denote flat plates. The flat plates 2 are fixed symmetrically in respect to the hub 1*a* at their inner sides 2*a*. Reference numerals 3 denote auxiliary vanes. The auxiliary vanes 3 are comprised of gutter-like plates having a substantially arcuate shape in section and having lengths equal to the upper and lower sides 2*b* of the flat plates 2. The auxiliary vanes have a clearance (t) with respect to the side edges of the flat plates 2, i.e., the upper and lower sides 2*b* and the auxiliary vanes are supported by the supporting columns 3*a* with their concave surfaces facing against a rotating direction of the rotary shaft 1.

With such an arrangement as described above, as the auxiliary vanes 3 are rotated together with the flat plates 2 during rotation of the rotary shaft 1, the gas-liquid flow reaches to the rear portions of the flat plates 2 by flows $F_1$, passing through the clearance (t) between the side edges of the flat plates 2 and the auxiliary vanes 3, and flows $F_2$ passing outward portions of the auxiliary vanes 3 as shown in FIG. 3.

The flows $F_1$ are thus regulated by the curved inner surfaces of the auxiliary vanes 3. Even if the eddy flows are generated at the rear portions of the side edges of the flat plates 2 by the auxiliary vanes 3, an occurrence of such eddy flows is reduced, its shearing force is weakened, a peeled-off eddy flow is reduced, and microorganisms in the gas-liquid are agitated.

Figure 4:
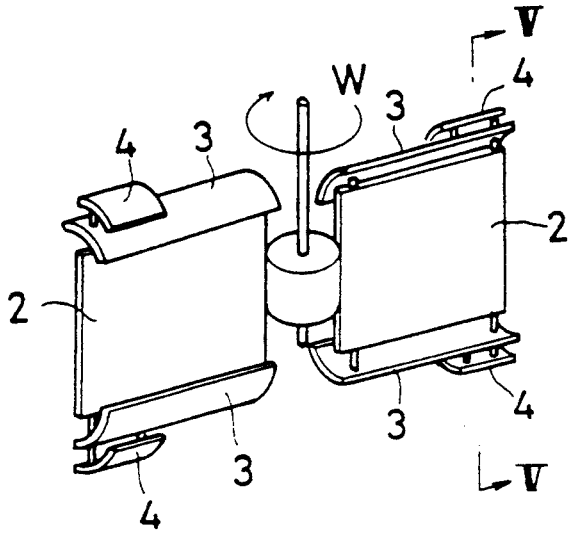
FIG. 4 is a perspective view showing the second preferred embodiment of the present Invention.
Figure 5:
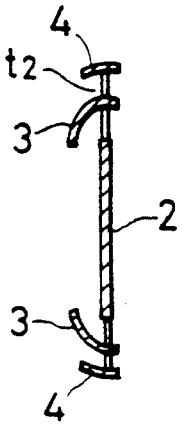
FIG. 5 is a sectional view taken along a line V—V of FIG. 4.

FIGS. 4 and 5 illustrate the second preferred embodiment of the present invention, wherein small auxiliary vanes 4 . . . . 4 are provided with clearances ($t_2$) outwardly of the auxiliary vanes 3. Thus, it becomes possible to reduce the peeled-off eddy flows being generated at the rear surfaces of end portions of the auxiliary vanes 3 and so the agitation of the gas-liquid is efficiently carried out.

Figure 6:
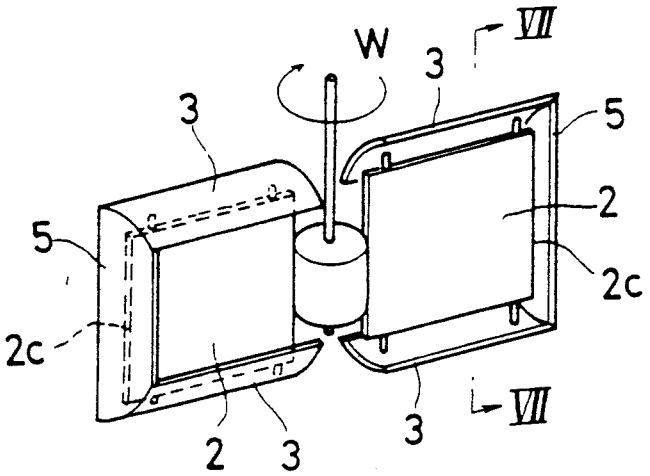
FIG. 6 is a perspective view showing the third preferred embodiment of the present invention.
Figure 7:
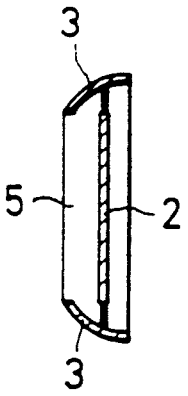
FIG. 7 is a sectional view taken along a line VII—VII of FIG. 6.

FIGS. 6 and 7 illustrate the third preferred embodiment of the present invention in which the outer sides 2c of the flat plates 2 have auxiliary vanes 5. Accordingly, the present invention has an effect that the eddy flows generated at all vane edges of the flat plates 2, are reduced, the peeled-off eddy flows are reduced and gas-liquid agitation is promoted.

In addition, the shape and arrangement of the auxiliary vanes 3 or the like can be optionally changed.

Figure 8:
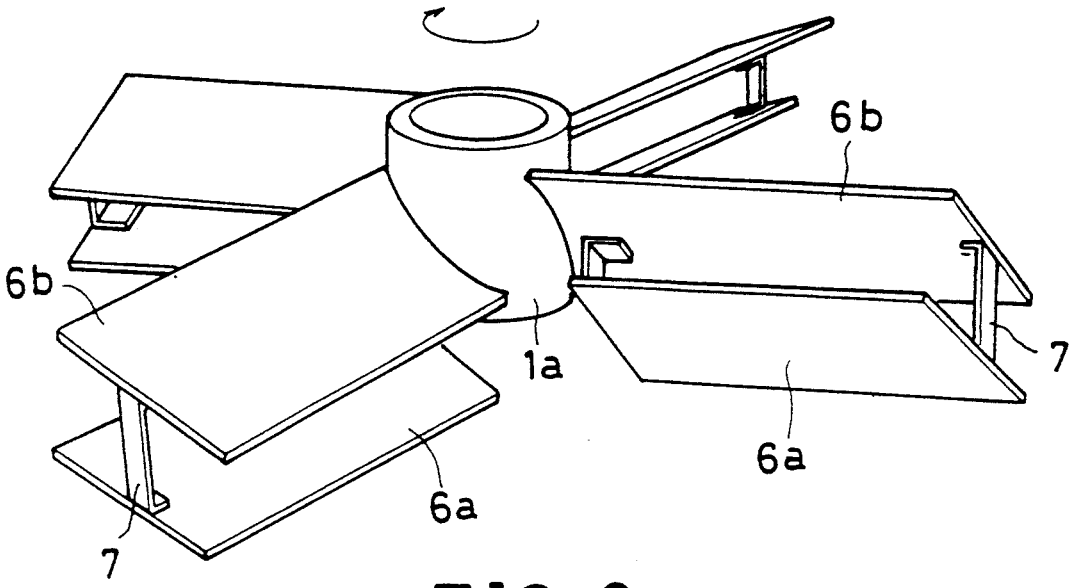
FIG. 8 is a perspective view showing the fourth preferred embodiment of the present invention.
Figure 9:
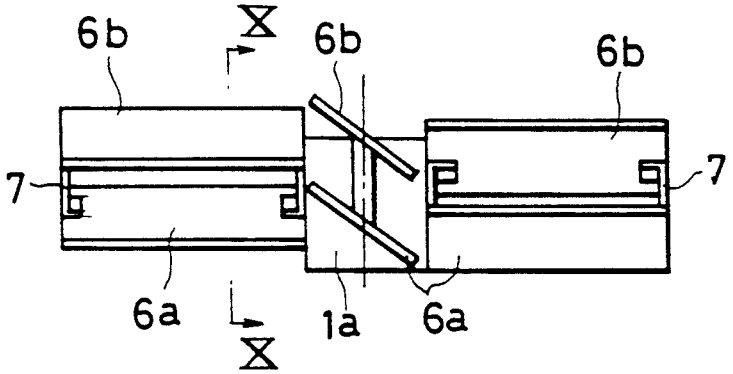
FIG. 9 is a front elevational view of FIG. 8.
Figure 10:
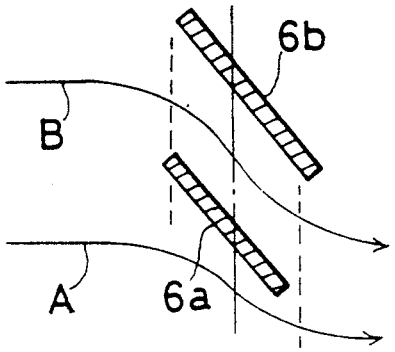
FIG. 10 is a sectional view taken along a line X—X of FIG. 9.

FIGS. 8 to 10 illustrate the fourth preferred embodiment of the present invention. In the fourth preferred embodiment, belt-like flat plates 6b are radially projected and inclined at an outer circumference of the hub 1a in such a way that their front ends are above and their rear ends are below in the rotational direction, and the auxiliary vanes 6a of belt-like plate shape are supported by the supporting pieces 7 over each of the plates 6b with a predetermined spacing.

The hub 1a is fixed to the lower end of the rotary shaft and the agitating vanes are rotated in the liquid in a direction indicated by an arrow, a flow indicated by B is generated by the flat plates 6b as shown in FIG. 10 and at the same time a fluid flow as indicated by A is generated by an auxiliary vane 6a. The phenomenon of peeling off caused by the liquid eddy flow at a position above the rear end portions of the flat plates 6b generated by the liquid flow in the case of conventional agitating vanes is eliminated or reduced. The liquid flows above and below the flat plates and their flow speeds and flow rates are thereby increased and the agitating action is smoothly carried out.

In this embodiment one auxiliary vane is provided. However, two or more auxiliary vanes may be spaced apart from each other, and further the flat plates and the auxiliary vanes may be set in such a way as their front ends are below and their rear ends are above as viewed in their rotational direction.

Figure 11:
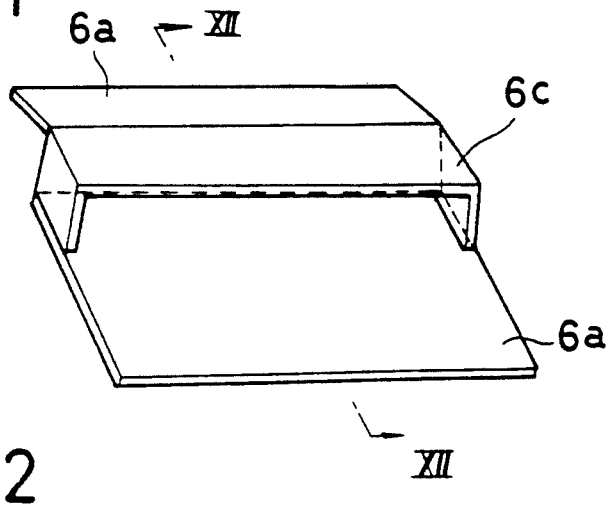
FIG. 11 is a perspective view showing a substantial part of the fifth preferred embodiment of the present invention.
Figure 12:
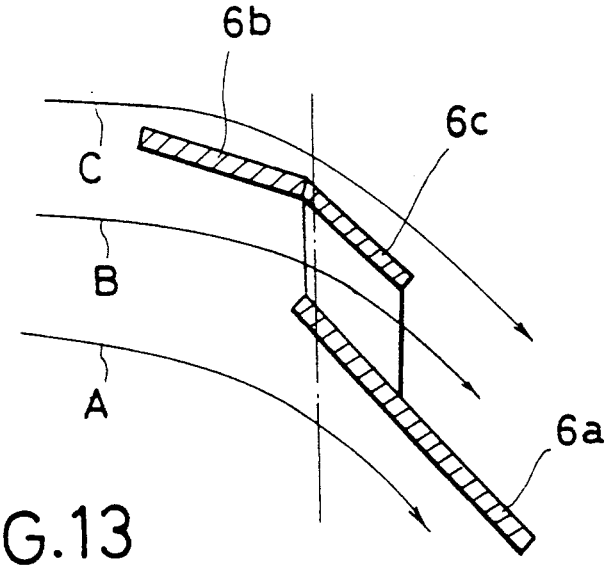
FIG. 12 is a sectional view taken along a line XII—XII of FIG. 11.

FIGS. 11 and 12 illustrate the fifth preferred embodiment of the present invention, wherein the auxiliary vane 6b positioned above is bent along its radial length at its intermediate portion. As the agitating vane is rotated in the liquid, the flow B above the flat plate 6a is bent by a steep slant rear part 6c of the auxiliary vane 6b, while the flow is positively flowed along the rear upper surface of the flat plate 6a. Peeling-off caused by the liquid eddy flow above the rear end of the flat plate 6a is positively prevented in the same manner as in the fourth preferred embodiment, the regulated flows above and below the flat plate 6a are attained and their speeds and the flow rates are increased. Further, since the rear portion 6c of the auxiliary vane 6b is steeply slanted, a negative pressure is formed above it, the liquid flow C is bent and the flow becomes a regulated flow having a high speed and a high flow rate without generating any peeling-off. The agitating efficiency can thus be improved.

Figure 13:
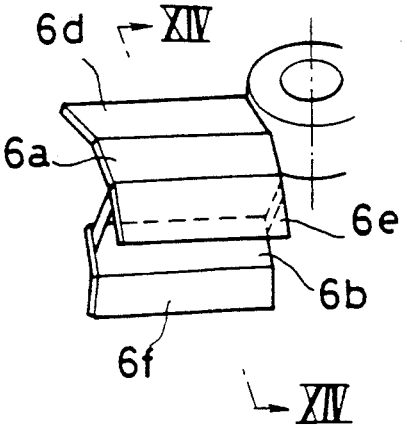
FIG. 13 is a perspective view showing a substantial part of the sixth preferred embodiment of the present invention.
Figure 14:
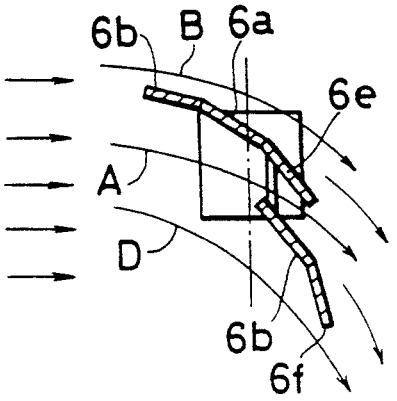
FIG. 14 is a sectional view taken along a line XIV—XIV of FIG. 13.

FIGS. 13 and 14 illustrate the sixth preferred embodiment of the present invention. In the sixth preferred embodiment, the front part 6d and the rear part 6e of the flat plate 6a are highly slanted and at the same time the rear part 6f of the auxiliary vane 6b is highly slanted. The auxiliary vane 6b is spaced apart below the flat plate 6a. Liquid flow B above the flat plate 6a does not show any peeling-off in the same manner as that of the auxiliary vane 6b in the fifth preferred embodiment due to the fact that the front part 6d and the rear part 6e of the flat plate 6a are highly slanted, resulting in that the flow becomes a regulated high speed flow. In addition, above the auxiliary vanes 6b, there is no peeling-off caused by the flow bent by the steeply slanted state of the rear part 6e of the flat plate 6a, producing a regulated flow having a high speed and a high flow rate. All the flow D below the auxiliary vane 6b and the flows A and B become regulated flows having high speed and high flow rate, resulting in a high agitating efficiency.

Figure 15:
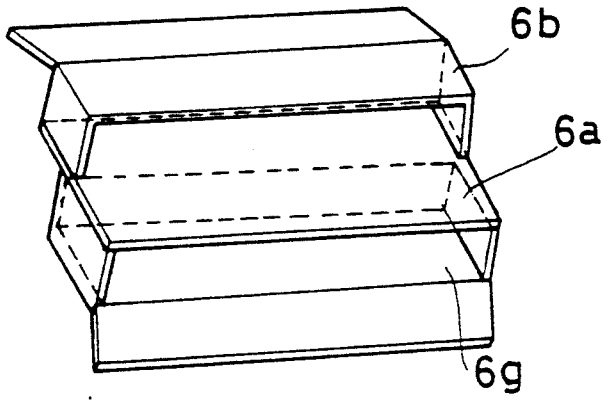
FIG. 15 is a perspective view showing a substantial part of the seventh preferred embodiment of the present invention.

FIG. 15 illustrates the seventh preferred embodiment of the present invention. In the seventh preferred embodiment, auxiliary vanes 6b and 6g are disposed above and below the flat plate 6a in a spaced-apart relation thereto, wherein the entire liquid flow is in a regulated flow state in which the flow of the fifth preferred embodiment and the flow of the sixth preferred embodiment are combined with each other, and so agitating efficiency is further improved.

Figure 16:
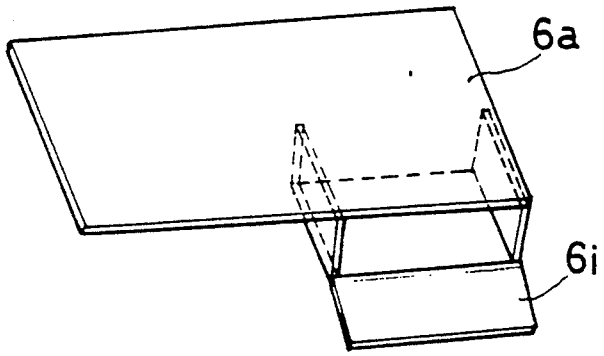
FIG. 16 is a perspective view showing a modification of the sixth preferred embodiment of the present invention.
Figure 17:
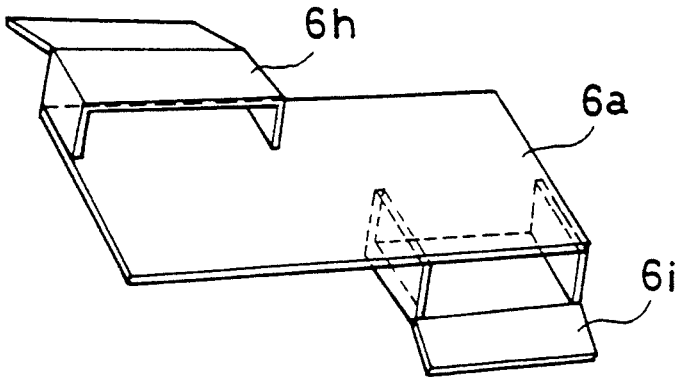
FIG. 17 is a perspective view showing a modification of the seventh preferred embodiment of the present invention.

FIGS. 16 and 17 illustrate examples of modifications of the sixth and seventh preferred embodiments of the present invention, respectively, wherein a regulated flow is mainly generated at a portion of the flat plate 6a of the auxiliary vanes 6h, 6i.

Even in case of these fifth to seventh preferred embodiments, the flat plates and the auxiliary vanes may be disposed as required in such a way as their front ends are inclined downwardly and their rear ends are inclined upwardly.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An agitating vane comprising:
a hub rotatable about an axis;
a plurality of flat plates laterally disposed at an outer circumference of the hub, said plates each being flat in all directions on an entirety of the surfaces thereof; and
auxiliary vanes disposed at side edges of each of said flat plates and in parallel therewith such that spaces are left between said flat plates and said auxiliary vanes,
wherein each of said flat plates is disposed laterally of said hub in an inclined manner in a rotational direction of the hub, each of said auxiliary vanes being formed as a plate shape and being spaced above or below each of the flat plates.

2. An agitating vane according to claim 1, wherein said auxiliary vanes have rear portions in a rotational direction, wherein the rear portions are more steeply inclined than are the flat plates.

3. An agitating van according to claim 2, wherein said auxiliary vanes have small areas as compared with said flat plates.

4. An agitating vane according to claim 2, wherein said flat plates have front portions in their rotational direction which are inclined relative to said auxiliary vanes.

5. An agitating vane comprising:
a hub rotatable about an axis;
a plurality of flat plates laterally disposed at an outer circumference of the hub; and
auxiliary vanes disposed at side edges of each of said flat plates and in parallel therewith such that spaces are left between said flat plates and said auxiliary vanes, wherein each of said flat plates is disposed laterally of said hub in an inclined manner in a rotational direction of the hub, each of said auxiliary vanes being formed as a plate shape and being spaced above or below each of the flat plates, and wherein said auxiliary vanes have small areas as compared with said flat plates.

* * * * *

UNITED STATES PATENT AND TRADEMARK OFFICE

CERTIFICATE OF CORRECTION

PATENT NO. : 5,330,325

DATED : July 19, 1994

INVENTOR(S) : Kohichi KATO, et al.

It is certified that error appears in the above-indentified patent and that said Letters Patent is hereby corrected as shown below:

On the title page, Item [54], and Column 1, Line 2, the title should read as follows:

--PARALLEL PLATE AGITATING VANE HAVING AUXILIARY VANES--

Signed and Sealed this

Twenty-seventh Day of September, 1994

*Attest:*

Bruce Lehman

BRUCE LEHMAN

*Attesting Officer*

*Commissioner of Patents and Trademarks*